US005409217A

United States Patent [19]

Bobby

[11] Patent Number: 5,409,217

[45] Date of Patent: Apr. 25, 1995

[54] TENNIS TRAINING DEVICE

[76] Inventor: Andrew Bobby, 17 Century Ct., Montville, N.J. 07045

[21] Appl. No.: 285,708

[22] Filed: Aug. 4, 1994

[51] Int. Cl.[6] ..... A63B 49/00

[52] U.S. Cl. ..... 273/73 R; 273/73 D; 273/29 A

[58] Field of Search ..... 273/73 R, 73 D, 29 R, 273/29 A

[56] References Cited

U.S. PATENT DOCUMENTS

| | | | |
|---|---|---|---|
| 2,932,514 | 4/1960 | Bergmark | 273/73 R |
| 4,063,730 | 12/1977 | Bates | 273/29 A |
| 4,076,239 | 2/1978 | Hall | 273/29 A |
| 4,249,728 | 2/1981 | Bratt | 273/29 A |

*Primary Examiner*—Raleigh W. Chiu
*Attorney, Agent, or Firm*—Alfred C. Hill

[57] ABSTRACT

A tennis training device comprising a tennis racket with its usual strings; a pair of rods each disposed on a different side of the strings adjacent a sweet spot of the strings; a first arrangement extending through the strings to detachably secure the pair of rods to each other; a predetermined number of spherical objects each having a predetermined diameter skewered on each of the pair of rods; each of the pair of rods having a length equal to the predetermined number times the predetermined diameter; and a second arrangement attached to an end of each of the pair of rods remote from the strings to hold at least one of the associated ones of the spherical objects in contact with an associated side of the strings; the spherical objects enabling development of visualization phenomena of the spherical objects hitting the sweet spot and simultaneously developing muscular control, muscule memory and muscle strength of grip, wrist, lower arm, upper arm and shoulder when repeatably simulating all actual tennis strokes.

20 Claims, 1 Drawing Sheet

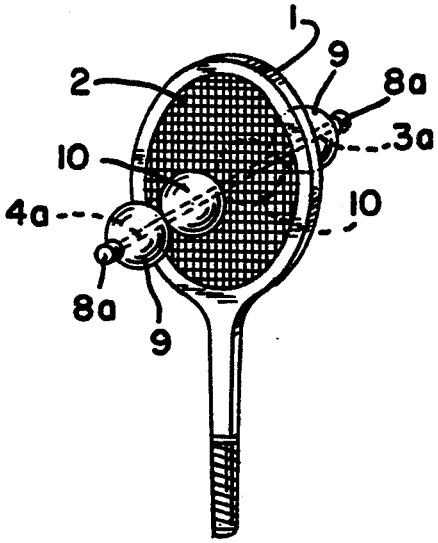
FIG. 2
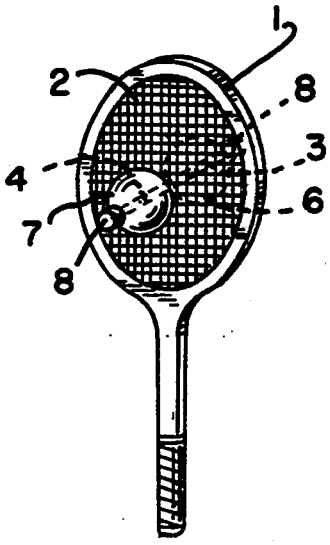
FIG. 1
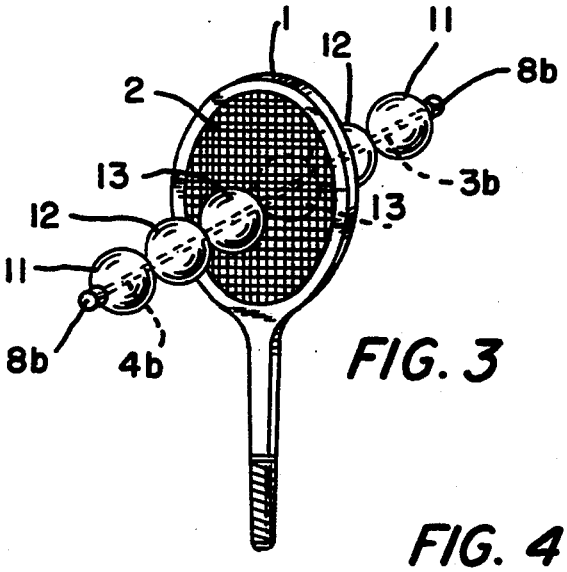
FIG. 3
FIG. 4
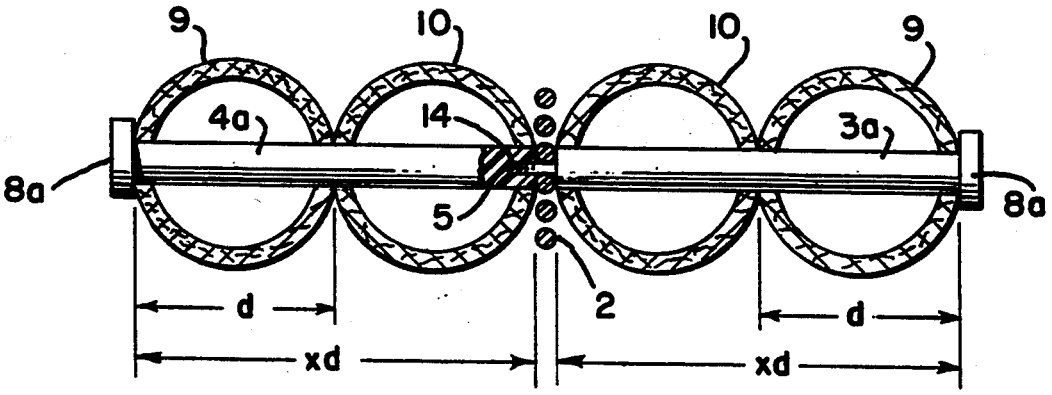

TENNIS TRAINING DEVICE

BACKGROUND OF THE INVENTION

The present invention relates generally to athletic training devices and more particularly to a tennis training device to develop player skill in striking a tennis ball with a tennis racket in such a manner that the ball is contacted by a desired particular portion of the stringed area of the racket and also to develop the muscular strength and control in all parts of a player's arm.

As is well known to players and teachers of the game of tennis, a tennis racket has a particular, relatively small portion of its stringed area which provides a maximum response when the tennis ball has been struck by this portion. This high-response area of the strings is widely known as the "sweet spot" of the racket. Consistently striking the ball with this area gives the player better control of the ball, and-allows the ball to be driven from the racket with a significantly higher velocity than would otherwise be obtainable. The sweet spot of the racket is not in exactly in the geometric center of the stringed area of the racket, but is generally located slightly off-center, closer to the handle of the racket.

As is also well known to players and teachers of tennis, contacting the ball with any portion of the racket other than the sweet spot can produce severe twisting and other stresses on the racket. These stresses and twists are transmitted to the arm of the player. Hitting the ball consistently with the sweet spot reduces these stresses, and thereby reduces likelihood of "tennis elbow" and other common complaints of amateur tennis players.

It is also desirable to provide a training device which will provide muscular memory and strength of grip, the wrist, lower arm or upper arm and shoulder of the player by providing a weighted device so that the foregoing is improved when repeatably simulating all actual tennis strokes.

U.S. Pat. No. 4,076,239 discloses a tennis teaching aid which enables teaching a tennis player how to strike a tennis ball more consistently with the sweet spot of the racket. The device of this patent includes two flat plates of relatively stiff but resilient material disposed on each side of the strings of the racket and clamped together against the strings by four threaded nuts and bolts engaging aligned holes in the plates. The device is provided with at least one area of padding material placed near the edge of each plate and between each plate and the strings of the tennis racket to emit a distinctive sound when struck at its center by a tennis ball, and gives out another distinctive but different sound when struck at an off center location.

An advertisement in the May 19, 1975 issue of *Sporting Goods Dealer,* at page 146 discloses a practice weight that fits over the racket which comprises one spherical object which is cut in half with a projection from one half passing through the strings of the racket to engage a bore in the other half of the spherical object. This weight type device can come in variable weights as stated in the advertisement.

U.S. Pat. No. 3,414,260 discloses an adjustable weight exerciser for athletic equipment, such as a tennis racket. In the arrangement disclosed in this patent an implement in the shape of a tennis racket without any tennis strings has a rod extending through the portion of the racket in line with the handle of the racket in the area where the strings normally would be with a weight disposed on this rod which is adjustable to provide muscular exercise and memory for the device being employed by the player.

None of the prior art mentioned above, which were the most pertinent prior art found in a search, disclose a tennis training device which trains the tennis player to hit the tennis balls in the sweet spot and simultaneously enables developing muscular control, muscular memory and strength of grip, wrist, lower arm, upper arm and shoulder when repeatably simulating all actual tennis strokes without requiring another player to hit a tennis ball to the player training.

SUMMARY OF THE INVENTION

An object of the present invention is to provide an improved tennis training device that enables the improvement of the player being able to hit the sweet spot of the tennis racket and also to improve the muscular memory and control as well of strength of the player's arm from the shoulder to the hand.

Another object of the present invention is to provide a tennis training device that does not require another player to hit a tennis ball to the person using the training device and yet enables the development of visualization phenomena or visual memory of the tennis ball hitting the racket strings and simultaneously developing the muscular control, muscle memory and muscle strength of the player's arm from the shoulder to the hand grip.

Still another object of the present invention is to provide a tennis training device that facilitates the transference of the visualization phenomena to the feel of hand, wrist, arm and shoulder as the racket face moves through the tennis stroke.

A further object of the present invention is to provide a tennis training device that can be employed by a single tennis player within a building without the necessity of having a tennis court or another player to hit the ball to the player using the training device.

A feature of the present invention is the provision of a tennis training device comprising a tennis racket with its usual strings; a pair of rods each disposed on a different side of the strings adjacent a sweet spot of the strings; first means extending through the strings to detachably secure the pair of rods to each other; a predetermined number of spherical objects each having a predetermined diameter skewered on each of the pair of rods; each of the pair of rods having a length equal to the predetermined number times the predetermined diameter; and second means attached to an end of each of the pair of rods remote from the strings to hold at least one of the associated ones of the spherical objects in contact with an associated side of the strings; the spherical objects enabling development of visual memory of the spherical objects hitting the sweet spot and simultaneously developing muscular control, muscular memory and strength of grip, wrist, lower arm, upper arm and shoulder of the player when repeatably simulating all actual tennis strokes.

BRIEF DESCRIPTION OF THE DRAWING

Above-mentioned and other features and objects of the present invention will become more apparent by reference to the following description taken in conjunction with the accompanying drawing, in which:

FIG. 1 is a perspective view of one embodiment of the tennis training device in accordance with the principles of the present invention;

FIG. 2 is a perspective view of a second embodiment of the tennis training device in accordance with the principles of the present invention;

FIG. 3 is a perspective view of a third embodiment of the tennis training device in accordance with the principles of the present invention; and FIG. 4 is cross-sectional view of the tennis training device employed in the embodiments of FIGS. 1–3 in accordance with the principles of the present invention.

DESCRIPTION OF THE PREFERRED EMBODIMENTS

Referring to FIG. 1, a perspective view of one embodiment of the tennis training device is disclosed. The tennis training device includes a tennis racket 1 with its usual strings 2. A pair of rods 3 and 4 are provided each disposed on a different side of the strings 2 adjacent the sweet spot of the strings. A first means, such as the threaded projection 5, extends through strings 2 at the sweet spot and is threadably received in a threaded bore 14 in rod 4 to hold the adjacent ends of the pair of rods against the strings 2 as shown in FIG. 4.

A predetermined number of spherical objects, such as tennis balls 6 and 7 having a predetermined diameter d are skewered on each of the pair of rods. The predetermined number of spherical objects or tennis balls in FIG. 1 is one in number on each of the rods 3 and 4.

Each of the rods 3 and 4 have a length Xd equal to the predetermined number X of spherical objects or tennis balls times the predetermined diameter d of the tennis balls. See FIG. 4. For example, in FIG. 1 if tennis balls 6 and 7 each have a diameter d of 2½ inches each of the rods would be 2½ inches in length. (Xd=1×2.5 inches)

A second means in the form of member 8 is attached to an end of each of the rods 3 and 4 remote from the strings 2 to hold the associated ones of the tennis balls 6 and 7 in contact with an associated side of the strings 2. Members 8 each are a circular member having a diameter greater than the diameter of rods 3 and 4 secured to the ends thereof by welding or soldering at right angles with respect to rods 3 and 4 to engage the surface of an adjacent one of tennis balls 6 and 7. Rods 3 and 4 and members 8 could also be machined as an integral unit.

With the training device as shown in FIG. 1 with the tennis balls 6 and 7 being held in position at the sweet spot of the strings 2, the player in training can develop a visualization phenomena of the tennis balls hitting the sweet spot and simultaneously develop muscular control, muscle memory and muscle strength of the grip, wrist, lower arm, upper arm and shoulder when repeatably simulating all actual tennis strokes. In addition transference of the visualization phenomena to feel is accomplished.

As the tennis player increases his muscular control and muscular memory it may be desired to increase the weight of the tennis racket. This is accomplished by providing rods **3*a* and 4*a* to accommodate two spherical objects or tennis balls 9 and 10 on each of the rods 3*a* and 4*a*. The cross section of the training device of FIG. 2 is shown in FIG. 4 and is representative of the training device arrangement for the embodiments of FIGS. 1, 2 and 3. In the embodiment of FIG. 2, the member 8*a* disposed at right angles to the associated one of the rods 3*a* and 4*a* bear against the adjacent one of the tennis balls, such as tennis ball 9, to hold the plurality of tennis balls against each other and the remote one of the tennis balls, such as tennis ball 10**, against the associated side of the strings.

To further increase the weight of the tennis racket to further develop the muscular control and muscular memory of the tennis player three tennis balls, or spherical objects 11, 12 and 13 can be skewered on each of the rods **3*b* and 4*b*. As with the previous two embodiments of FIGS. 1 and 2, the rods are held against the strings 2 and detachably secured to one another by the threaded projection 5 and the threaded bore 14 as shown in FIG. 4**.

The length Xd of rods **3*a* and 4*a*, assuming the tennis balls 9 and 10 are 2½ inches in diameter, would be 2×2.5 inches or 5 inches in length. In the embodiment of FIG. 3, the rods 3*b* and 4*b*** would have a length Xd equal to 3×2.5 inches which equal 7½ inches.

With the training device of the present invention any number or plurality of spherical objects or tennis balls can be skewered on the rods 3 and 4 that have the appropriate length to accommodate the number of tennis balls employed to increase the weight of the tennis racket for muscular control and muscular memory through increased strength of the grip, wrist, lower arm, upper arm and shoulder of the player.

As pointed out hereinabove the tennis training device of the present invention aids in the development of the visualization phenomena of the eye "seeing" the ball on the racket strings at the sweet spot as the racket "meets" the ball on any and all strokes in slow motion. This same device helps develop muscle memory and muscular control of the racket head through increased strength of the grip, wrist, lower arm, upper arm and shoulder of the player by simulating all actual tennis strokes through incrementally increasing the weight of the head of the racket by increasing the number of tennis balls skewered on the rods having the appropriate length to accommodate the tennis balls.

The rods 3, 4, **3*a*, 4*a*, and 3*b*, 4*b*** can be made of any appropriate material, but preferably is made of plastic.

As clearly illustrated in FIG. 4 the rods passes through the center of the spherical object or tennis balls involved.

While I have described above the principles of my invention in connection with specific apparatus, it is to be clearly understood that this description is made only by way of example and not as a limitation to the scope of my invention as set forth in the objects thereof and in the accompanying claims.

I claim:

1. A tennis training device comprising:

a tennis racket having strings;

a pair of rods each disposed on a different side of said strings adjacent a sweet spot of said strings;

first means extending through said strings to detachably secure said pair of rods to each other;

a predetermined number of spherical objects each having a predetermined diameter skewered on each of said pair of rods;

each of said pair of rods having a length equal to said predetermined number times said predetermined diameter; and second means attached to an end of each of said pair of rods remote from said strings to hold at least one of the associated ones of said spherical objects in contact with an associated side of said strings;

said spherical objects enabling development of visual memory of said spherical objects hitting said sweet spot and simultaneously developing muscular control, muscule memory and muscle strength of grip, wrist, lower arm, upper arm and shoulder when repeatedly simulating all actual tennis strokes.

2. A device according to claim 1, wherein said first means includes a threaded projection extending from one of said pair of rods through said strings; and a threaded bore in the other of said pair of rods to threadably receive said projection to hold adjacent ends of said pair of rods against said strings.

3. A device according to claim 2, wherein said spherical objects are tennis balls.

4. A device according to claim 3, wherein said predetermined number equals one.

5. A device according to claim 4, wherein said second means includes a member disposed at right angles to each of said pair of rods bearing against said one tennis ball to hold it against said associated side of said strings.

6. A device according to claim 5, wherein each of said pair of rods is a plastic rod.

7. A device according to claim 3, wherein said predetermined number equals a plurality.

8. A device according to claim 7, wherein said second means includes a member disposed at right angles to each of said pair of rods bearing against an adjacent one of said tennis balls to hold said plurality of tennis balls against each other and a remote one of said tennis balls against said associated side of said strings.

9. A device according to claim 8, wherein each of said pair of rods is a plastic rod.

10. A device according to claim 3, wherein said predetermined number equals two.

11. A device according to claim 10, wherein said second means includes a member disposed at right angles to each of said pair of rods bearing against an adjacent one of said tennis balls to hold said two tennis balls against each other and a remote one of said tennis balls against said associated side of said strings.

12. A device according to claim 11, wherein each of said pair of rods is a plastic rod.

13. A device according to claim 3, wherein said predetermined number equals three.

14. A device according to claim 13, wherein said second means includes a member disposed at right angles to each of said pair of rods bearing against an adjacent one of said tennis balls to hold said three tennis balls against each other and a remote one of said tennis balls against said associated side of said strings.

15. A device according to claim 14, wherein each of said pair of rods is a plastic rod.

16. A device according to claim 1, wherein said spherical objects are tennis balls.

17. A device according to claim 16, wherein said predetermined number equals one.

18. A device according to claim 17, wherein said second means includes a member disposed at right angles to each of said pair of rods bearing against said one tennis ball to hold it against said associated side of said strings.

19. A device according to claim 16, wherein said predetermined number equals a plurality.

20. A device according to claim 19, wherein said second means includes a member disposed at right angles to each of said pair of rods bearing against an adjacent one of said tennis balls to hold said plurality of tennis balls against each other and a remote one of said tennis balls against said associated side of said strings.

* * * * *